United States Patent [19]

Thiltgen et al.

[11] 4,308,968

[45] Jan. 5, 1982

[54] SECONDARY SEAL FOR TANK HAVING FLOATING ROOF

[75] Inventors: Roger W. Thiltgen, Cerritos; T. Richard Mathews, Los Alamitos, both of Calif.; Walter L. Hurst, Beaumont, Tex.

[73] Assignee: H.M.T., Inc., Beaumont, Tex.

[21] Appl. No.: 155,929

[22] Filed: Jun. 3, 1980

[51] Int. Cl.[3] ..... B65D 88/42; B65D 88/43

[52] U.S. Cl. ..... 220/222; 220/221

[58] Field of Search ..... 220/216–227

[56] References Cited

U.S. PATENT DOCUMENTS 2,981,438 4/1961 Heisterberg ..... 220/219

4,099,643 7/1978 Wardwell et al. ..... 220/222

*Primary Examiner*—George T. Hall

*Attorney, Agent, or Firm*—Fraser and Bogucki

[57] ABSTRACT

An arrangement for sealing the space between the outer rim of a floating roof and the inner wall of a tank includes a primary seal coupled to and extending between the inner wall of the tank and the rim and a secondary seal mounted on the rim of the roof and extending upwardly and outwardly and into contact with the inner wall of the tank above the primary seal. The primary seal comprises a flexible vapor barrier element. The secondary seal is made highly flexible and readily able to conform to the inner wall of the tank by use of a support structure in the form of a plurality of support plates mounted on the rim of the roof in side-by-side relation with overlapping but unjoined edges. The support plates support and force a pair of wipers mounted on top of the plates into contact with the inner wall of the tank. The support structure is made vapor-impermeable by a flexible vapor barrier mounted at one end between the rim of the roof and the lower ends of the support plates and extending along the support plates and between the tops of the plates and the wipers so as to wrap at least partly around the wipers. The vapor barrier seals the region between the rim of the roof and the wipers and at the same time is protected from weather and sunlight by the support plates. Relatively free flexing of the wipers so as to conform to the relatively continuous inner wall of a welded tank is provided by breaks in each wiper which are spaced apart along the length thereof and yet staggered relative to the breaks in the other wiper to seal the area between the top of the support structure and the inner wall of the tank.

18 Claims, 7 Drawing Figures

SECONDARY SEAL FOR TANK HAVING FLOATING ROOF

BACKGROUND OF THE INVENTION

1. Field of the Invention

The present invention relates to arrangements for sealing the floating roof of a liquid storage tank such as a gasoline storage tank, and more particularly to arrangements in which both primary and secondary seals are employed to seal the space between the floating roof and the inner wall of the tank.

2. History of the Prior Art

With increasingly stringent pollution standards being set in connection with the storage of gasoline and other volatile liquids, it has become commonplace to seal the space between a floating roof and the inner walls of a tank in which such liquids are stored. Examples of such seals are provided by U.S. Pat. Nos. 4,099,643 of Wardwell et al, 4,138,032 of McCabe, 4,130,217 of Hills et al, 3,735,891 of Nishkian et al, 3,167,206 of Nelson, 1,986,869 of Welp and 1,992,221 of Kramer.

The arrangement shown in the Wardwell et al patent includes a primary seal extending between the floating roof and the tank inner wall and a secondary seal which is mounted on the primary seal and which includes a plurality of wipers separated by spacer blocks. In the McCabe patent a primary seal combines with a secondary seal in the form of a single wiper having stiffeners mounted therein. In the arrangement shown in the Hills et al patent a primary seal is used in conjunction with a secondary seal supported by plates the top ends of which are disposed at or substantially in contact with the tank inner wall. The Nishkian et al patent shows a single seal which utilizes a tubular sealing member having a flanged wear cover and a flexible core member. The sealing arrangement shown in the Nelson patent includes a primary seal in combination with a secondary seal comprised of springs mounted on a fabric barrier. In the Welp patent a flexible sealing cover is disposed around the periphery of the main deck, beneath a number of segments which comprise a watershed. The arrangement shown in the Kramer patent uses a gas-tight fabric in conjunction with overlapping metal shoes engaging the side wall of the tank.

The various sealing arrangements of the prior art including those which employ both a primary seal and a secondary seal have been found incapable of meeting current evaporation and pollution standards in many instances. This is due to a number of factors which relate to the designs of such arrangements. In a typical installation, the primary seal substantially limits the escape of vapors from the liquid stored in the tank. However, the difficulty of providing a perfectly vapor-tight seal both at the juncture of the primary seal and the wall of the tank and at the juncture of the primary seal and the floating roof places a practical limit on the effectiveness of such a seal. Moreover, the body of the primary seal itself may leak due to minor damage or other deterioration with continued use. For this reason it has become commonplace to employ a secondary seal in conjunction with the primary seal, the secondary seal trapping the relatively small amount of vapors which get by the primary seal. However, most secondary seals are of limited effectiveness, due mostly to the difficulty in designing a different type of seal which must work in harmony with the primary seal. Of equal importance is the fact that the secondary seal must be capable of cooperating with the primary seal in accommodating the variety of different conditions occurring within the tank. In addition to variations introduced by climatic factors such as wind and temperature change, the tank itself may distort or undergo other aberrations making the continuous maintenance of a vapor-tight seal very difficult. For example, in the Wardwell et al patent the secondary seal which is dependent on the primary seal for its support and which itself is of rigid construction is not capable of conforming to the changing conditions so as to provide acceptable results in certain applications. Similar comments apply to McCabe where the single wiper element, although of relatively simple and inexpensive construction, is often incapable of functioning both as a vapor barrier and at the same time a sealing element to be maintained in contact at all times with the tank wall. In the Hills et al. arrangement the plates comprising the support structure for the secondary seal provide both a rigid and a flexible support but lack some means of maintaining an effective seal between their upper ends and the tank wall. In some arrangements such as that shown in the Nelson patent relatively fragile fabric is exposed to the weather and to direct sunlight, resulting in a greatly shortened useful life for such materials and the resultant leakage which occurs between the time such materials deteriorate or fail and are replaced.

Accordingly, it is an object of the invention to provide an improved sealing arrangement for use with tanks having a floating roof.

It is a further object of the invention to provide an improved secondary seal which is highly flexible and capable of conforming to changing shapes and sizes of the surrounding walls and parts.

It is a still further object to provide a secondary seal which in addition to being highly flexible and accommodating is arranged to protect the vapor-impermeable portions thereof against rapid wear and deterioration.

BRIEF DESCRIPTION OF THE INVENTION

The above and other objects are accomplished in accordance with the invention by a sealing arrangement which includes a primary seal coupled between the outer rim of a floating roof and the inner wall of a tank and a secondary seal mounted on the roof rim and extending into substantially continuous contact with the tank wall above the primary seal. The secondary seal is highly flexible and capable of assuming a changing set of configurations. At the same time the design of the secondary seal is such as to maintain the vapor-impermeable characteristic thereof in the face of weather, sunlight and other adverse factors. In a preferred embodiment of a sealing arrangement in accordance with the invention a primary seal of flexible vapor-barrier material extends between and is coupled to the rim of the roof and the inner wall of the tank. The secondary seal comprises a flexible support structure mounted on the rim of the roof so as to extend upwardly and outwardly above the primary seal. The support structure provides more than adequate support for and mounts a pair of flexible wipers at an upper lip thereof, the support structure forcing the wipers into contact with the wall of the tank. At the same time, the support structure comprises a highly flexible, distortable arrangement in which the circumference of the upper lip thereof can be changed so as to conform to varying changes in the tank wall and the surrounding parts. This is accomplished by making the support structure from a plurality of metal support plates which are mounted in side-by-side relation along the rim of the roof. The support plates overlap adjacent support plates without being fastened thereto so as to provide the desired flexibility characteristic while at the same time protecting a flexible vapor barrier mounted beneath the support plates. The vapor barrier which has one end disposed between the support plates and the rim of the roof and the other end extending between the upper lip of the support plates and the wipers renders the flexible support structure vapor-impermeable. The upper end of the vapor barrier which extends between the upper lip of the support plates and the wipers is preferably wrapped around a substantial portion of the wipers so as to even further enhance the vapor sealing characteristic of this part of the structure. The highly flexible nature of the support structure is maintained in the face of the wipers which are mounted on the top lip thereof by providing a break or separation in each wiper at selected locations spaced along the lengths of the wipers. At the same time the wipers are maintained virtually vapor-impermeable in the face of such breaks or separations by staggering the breaks in each wiper relative to the other wiper.

The wipers may be mounted on the upper lip of the support structure with the upper end of the vapor barrier sandwiched therebetween using bolts or other appropriate fasteners spaced along the lengths of the wipers. The same bolts or fasteners may be used to secure skid plates to the upper lip of the support structure. Where desired common bolts can be used to secure the lower end of the vapor barrier as well as the flexible material comprising the primary seal to the rim of the roof while at the same time mounting the plates of the support structure on the roof rim, the lower end of the vapor barrier and the inner end of the flexible material comprising the primary seal being sandwiched between the lower ends of the support plates and the rim of the roof.

BRIEF DESCRIPTION OF THE DRAWINGS

The foregoing and other objects, features and advantages of the invention will be apparent from the following more particular description of preferred embodiments of the invention, as illustrated in the accompanying drawings, in which.

DETAILED DESCRIPTION

Figure 1:
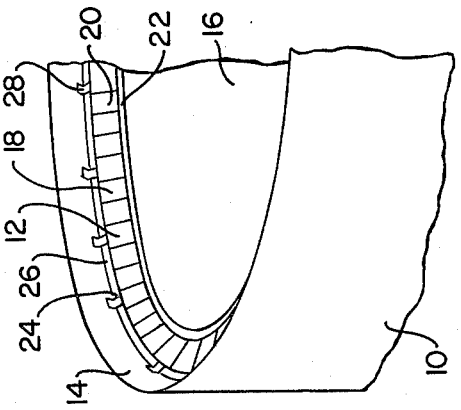
FIG. 1 is a perspective view of a portion of a tank having a sealing arrangement in accordance with the invention.

FIG. 1 depicts a tank 10 utilizing a sealing arrangement 12 in accordance with the invention. The tank 10 is generally cylindrical in configuration, and may comprise a gasoline storage tank or similar tank for storing a volatile liquid. The sealing arrangement 12 is disposed between and seals the space between an inner wall 14 of the tank 10 and a roof 16 which floats on the surface of the gasoline or other liquid in the tank 10. As described in detail hereafter the sealing arrangement 12 includes a secondary seal 18. The secondary seal 18 has a flexible support structure 20 mounted on and extending upwardly and outwardly from a rim 22 at the outer periphery of the roof 16. The support structure 20 terminates in an upper lip 24 on which are mounted a pair of wipers 26 which extend into contact with the inner wall 14. Also mounted on the upper lip 24 are a plurality of skid plates 28.

As will become more readily apparent from the discussion to follow the support structure 20 is constructed so that the circumference of the upper lip 24 can change as the structure 20 is flexed inwardly and outwardly. This enables the upper lip 24 of the support structure 20 to closely follow the inner wall 14 despite variations in the shape and size of the tank 10 and the roof 16 and the relative disposition thereof. At the same time the area between the rim 22 of the roof 16 and the upper lip 24 of the support structure 20 is sealed by a flexible vapor barrier. The area between the upper lip 24 of the support structure 20 and the inner wall 14 is sealed by the wipers 26 which not only move with the upper lip 24 of the support structure 20 but also flex to make a tight, sealing fit against the wall 14 under pressure exerted by the support structure 20.

Figure 2:
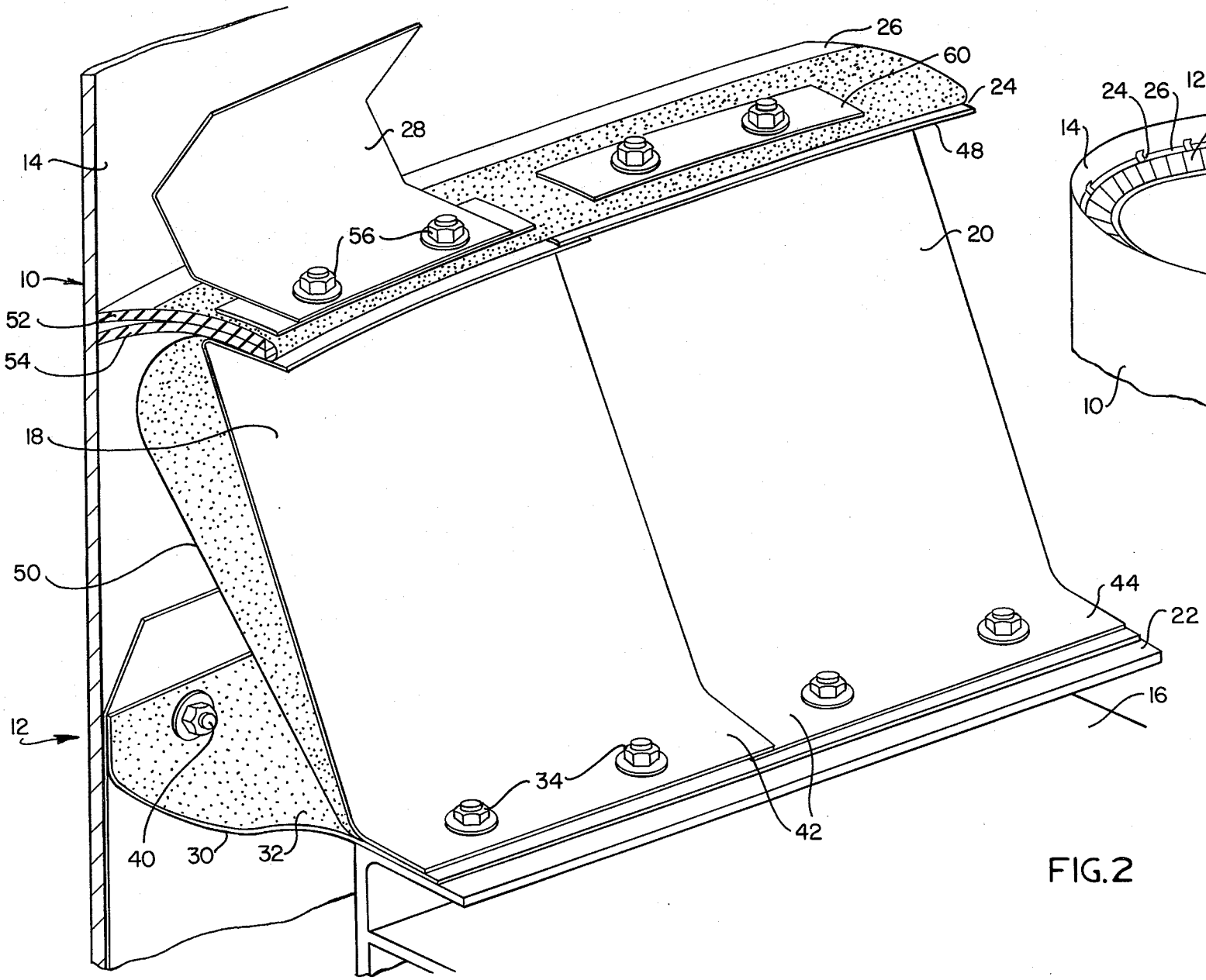
FIG. 2 is a perspective view of a portion of the sealing arrangement of FIG. 1.
Figure 3:
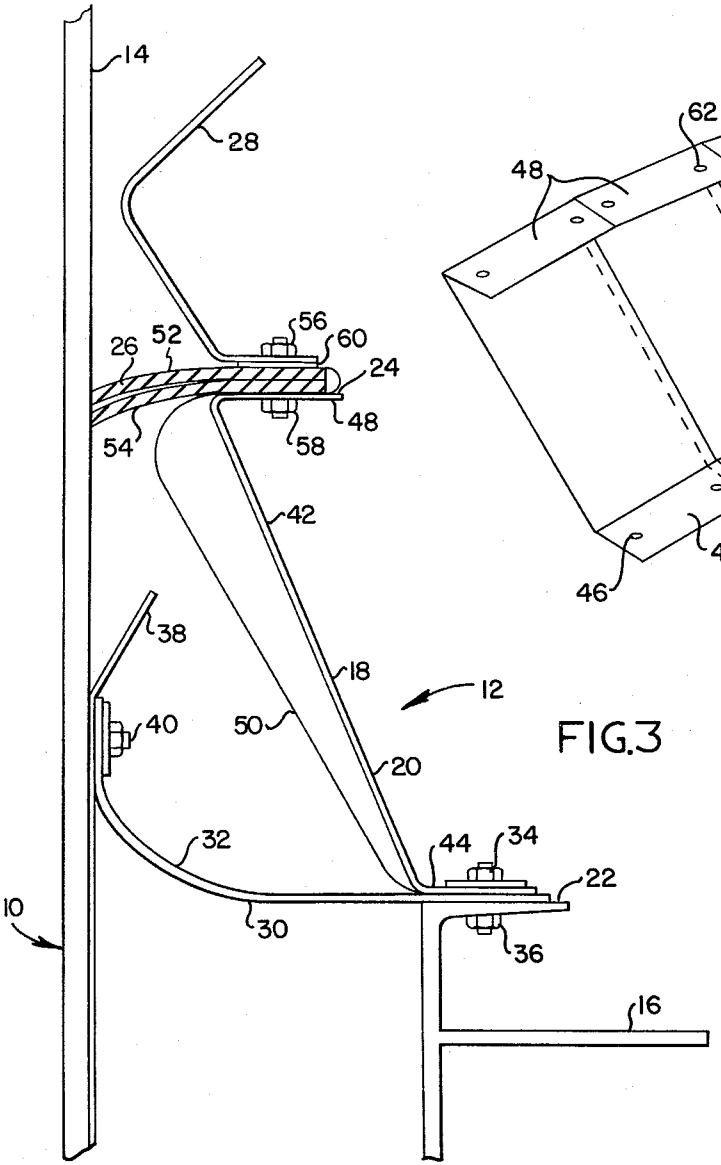
FIG. 3 is an end view of the arrangement of FIG. 2.

FIGS. 2 and 3 depict a portion of the sealing arrangement 12 of FIG. 1. In addition to the secondary seal 18, the sealing arrangement 12 includes a primary seal 30. The primary seal 30 is comprised of a flexible layer 32 of vapor barrier material extending between and being joined to the roof rim 22 and the tank wall 14. One end of the vapor barrier layer 32 is disposed on top of the rim 22 where it is securely fastened to the rim 22 by a plurality of bolts 34 and nuts 36. The opposite end of the vapor barrier layer 32 is secured to a thin plate 38 mounted on the inner wall 14 by a plurality of bolts 40 which extend into the wall 14 of the tank 10.

The vapor barrier layer 32 comprising the primary seal 30 prevents evaporation or other emissions of the gasoline or other liquid stored in the tank 10 through the space between the inner wall 14 of the tank 10 and the roof 16. However, it is difficult to achieve a perfectly tight fit of the vapor barrier layer 32 against the inner wall 14 and the roof rim 22 around the entire circumference of the tank and the roof. In addition, constant exposure of a piece of material such as the vapor barrier layer 32 to the weather and sunlight in addition to flexing of the layer 32 caused by relative movement of the roof 16 with respect to the inner wall 14 eventually cause deterioration in the layer 32. These factors combine to allow some escape of vapors from the gasoline or other liquid. Because the level of such escaping vapors is often unacceptable or in violation of local or state law it is highly desirable if not necessary to combine the secondary seal 18 with the primary seal 30. The secondary seal 18 resides above the primary seal 30 and forms a separate seal between the rim 22 of the roof 16 and the inner tank wall 14.

Figure 4:
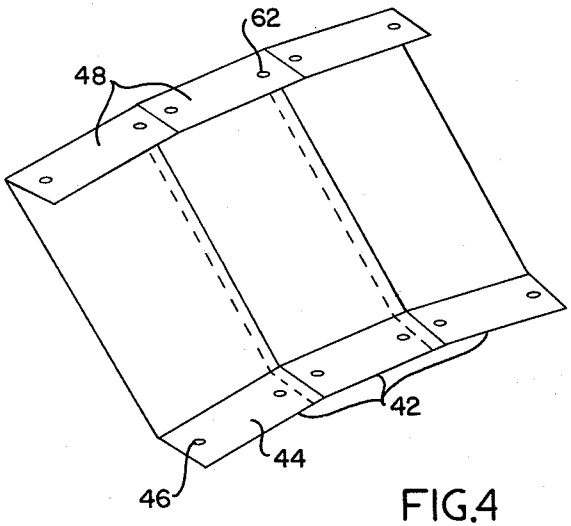
FIG. 4 is a perspective view of several support plates used in the arrangement of FIG. 2.

In the present example the support structure 20 is comprised of a plurality of support plates 42. The support plates 42 which are generally rectangular in shape are mounted in side-by-side relation around the rim 22 such that the opposite edges of each plate 42 overlap but are not attached to the edges of adjacent ones of the support plates 42. As seen in FIG. 2 the left one of the support plates 42 has an edge which overlaps the right support plate. This is also shown in FIG. 4 which depicts three of the support plates 42. Each support plate 42 has a lower lip 44 which is disposed on top of the vapor barrier layer 32 on the rim 22. As seen in FIG. 4 the lower lip 44 is provided with two different apertures 46 through which the bolts 34 pass to secure the lower lips 44 of the support plates 42 to the rim 22. The main portion of each support plate 42 extends upwardly and away from the rim 22 and terminates in an upper lip 48. The upper lips 48 of the various support plates 42 combine to form the upper lip 24 of the support structure 20.

It will be appreciated that because the adjacent support plates 42 overlap but do not join, they provide a support structure 20 which is highly flexible to accommodate changing conditions within the tank 10. Because the adjacent edges of the support plates 22 are laterably slidable relative to each other, particularly adjacent the tops of the support plates 42 and at the upper lips 48, the circumference of the upper lip 24 formed by the upper lips 48 of the plates 42 changes in response to deflection of the support plates 42. This feature has been found to be highly advantageous in enabling the support structure 20 to follow substantially varying conditions within the tank 10. At the same time, the overlapping support plates 42 provide a generally continuous if not gas-impervious structure which functions to protect a vapor barrier layer 50 disposed thereunder from the harmful effects of the weather and sunlight.

The vapor barrier layer 50 is comprised of flexible material and extends between the lower lip 44 and the upper lip 48 of each support plate 42. At the lower lip 44 of each support plate 42, the vapor barrier layer 50 is sealed to the rim 22 of the roof 16 by being disposed between the lower lip 44 of the support plate 42 and an end of the vapor barrier layer 32 of the primary seal 30. The bolts 34 pass through the lower end of the vapor barrier layer 50 to provide a gas-tight fit at the rim 22. The opposite end of the vapor barrier layer 50 extends between the upper lip 48 of the support plates 42 and the wipers 26. In the present example the wipers 26 comprise an upper wiper 52 which overlays a lower wiper 54. The lower wiper 54 has an edge thereof mounted on the upper lips 48 of the support plates 42 through the vapor barrier layer 50.

In accordance with the invention the vapor barrier layer 50 extends between the lower wiper 54 and the upper lip 48, from which it wraps around the edges of the wipers 52 and 54 and extends over at least a portion of the upper wiper 52 so as to be wrapped around a substantial portion of the wipers 52 and 54. This feature enhances the gas seal in the region of the upper end of the vapor barrier layer 50 and the wipers 52 and 54.

The wipers 52 and 54 and the vapor barrier layer 50 are secured to the upper lips 48 of the support plates 42 by bolts 56 and nuts 58. A different hold-down bar 60 of length shorter than the length of the upper lip 48 of each support plate 42 is preferably disposed over the upper lip 48 of a different support plate 42 so as to receive the bolts 56 before the bolts 56 penetrate the upper end of the vapor barrier layer 50 and the wipers 52 and 54. In addition, a different one of the skid plates 28 is mounted on top of selected ones of the hold-down bars 60. The skid plate 28 extends toward the tank wall 14 before undergoing curvature and extending away from the wall 14. In the present example a skid plate 28 is mounted on the upper lip 48 of every third one of the support plates 42. The skid plates 28 help to absorb shock in the event the secondary seal 18 is suddenly driven toward the tank wall 14. In addition the skid plates 28 tend to maintain a nominal distance between the upper lips 48 of the support plates 42 and the tank wall 14, enabling the flexible wipers 52 and 54 to reside against the tank wall 14 in such a way as to maintain a seal therewith. Two different ones of the bolts 56 are used to secure each skid plate 28 to the upper lip 48 of a different support plate 42 through a different one of the hold-down bars 60. The upper lip 48 of each support plate 42 is provided with two corresponding apertures 62 as shown in FIG. 4.

As previously noted the support structure 20 is highly flexible so as to position the upper lip 24 thereof adjacent the tank wall 14 at substantially all times and under substantially all conditions. At the same time the support structure 20 is made vapor-impermeable due to the presence of the vapor barrier layer 50 which is protected from sunlight and from the elements by the overlapping support plates 42. The flexible nature of the support structure 20 combines with the nature of the wipers 52 and 54 so as to position at least one and typically both of the wipers 52 and 54 against the tank wall 14 to maintain the secondary seal 18 as an effective seal. The support plates 42 are somewhat resilient in nature and are positioned so that they normally force the wipers 52 and 54 into the wall 14 with some pressure. The wipers themselves provide some resiliency in this connection.

The use of two wipers is ideally suited to welded tanks in which the inner wall 14 does not have significant discontinuities at the metal seams. In the case of the riveted tanks where substantial discontinuities can occur at the seams, larger numbers of wipers may be required and allowance may have to be made in the support structure to accommodate the stepped seams of the inner wall 14.

Figure 5:
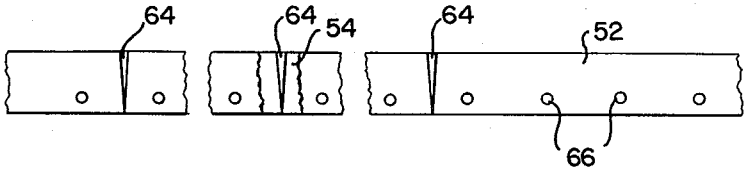
FIG. 5 is a top view of the wipers used in the arrangement of FIG. 2.

Because the upper lips 48 of adjacent support plates 42 are moved toward and away from each other as the circumference of the upper lip 24 changes, the wipers 52 and 54 which are fastened to the upper lips 48 by the bolts 56 must permit this movement. This is accomplished by providing an occasional break or separation across at least a substantial portion of the width of each of the wipers. As shown in FIG. 5 which is a view looking down on top of the upper wiper 52, each of the wipers 52 and 54 has a periodic separation 64 therein. In the present example the wipers 52 and 54 are approximately 4½" in width, and each separation 64 extends through at least 4" of that width. The separations 64 within each wiper are located approximately 4" apart along the lengths of the wipers. At the same time the separations 64 of the two different wipers 52 and 54 are staggered relative to one another. Thus, as shown in FIG. 5, each separation 64 within the lower wiper 54 occurs at a point approximately midway between an adjacent pair of separations 64 in the upper wiper 52. The staggering of the separations 64 keeps the assembly of wipers 52 and 54 virtually gas-impervious while at the same time lending enough flexibility for the support structure 20 to operate properly. As seen in FIG. 5 the wipers 52 and 54 are provided with a series of apertures 66 adjacent one edge thereof for receiving the bolts 56.

Figure 6:
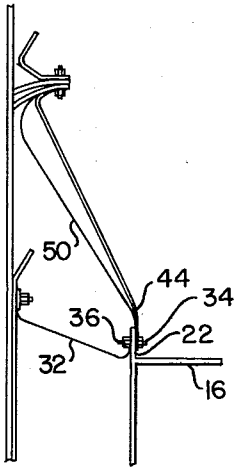
FIG. 6 is an end view of an arrangement slightly different than that shown in FIG. 3.

In the particular embodiment of FIGS. 2–4 the rim 22 of the roof 16 is generally horizontally disposed. However, the principles of the invention are applicable to other roof arrangements such as the arrangement shown in FIG. 6 where the rim 22 of the roof 16 is generally vertically disposed. The arrangement of FIG. 6 is otherwise the same as that of FIGS. 2–4 except that the lower lip 44 of each support plate 42 is curved so as to extend downwardly rather than outwardly. The lower lips 44 of the support plates 42 and the lower end of the vapor barrier layer 50 are disposed on one side of the generally vertical rim 22 opposite the vapor barrier layer 32 of the primary seal 30. The bolts 34 extend through the lower lips 44 and the vapor barrier layer 50 before extending through the rim 22 and the vapor barrier layer 32 and then receiving the nuts 36.

Figure 7:
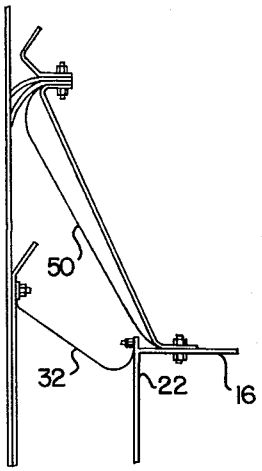
FIG. 7 is an end view of an arrangement slightly different from the arrangements shown in FIGS. 3 and 6.

In a still different arrangement shown in FIG. 7 the roof 16 is configured similarly to the roof shown in FIG. 6 so as to have a generally vertically disposed rim 22. In the FIG. 7 arrangement the end of the vapor barrier layer 32 of the primary seal 30 is secured to the vertical portion of the rim 22. However the lower end of the vapor barrier layer 50 and the lower lips 44 of the support plates 42 are secured to a different, generally horizontal portion of the rim 22.

The secondary seal 18 is desirably made of non-corrosive materials capable of withstanding the fumes and vapors from gasoline or other liquids to be stored in the tank 10. In examples described herein the support plates 42 are made of 16 or 18 gauge metal which can be stainless steel or galvanized. The vapor barrier layer 50 is comprised of a reinforced polyurethane fabric which is 100% aromatic. The wiper blades 52 and 54 are made either of neoprene or cast urethane. Other items of hardware such as the skid plates 28 and the hold-down bars 60 may be made of material such as 10 gauge galvanized steel. The various bolts 34 and 56 and nuts 36 and 58 are preferably plated or of stainless steel.

Sealing arrangements employing the secondary seal 18 in accordance with the invention have been found capable of substantial reductions in emissions when compared with prior art arrangements employing both primary and secondary seals or only a primary seal as described earlier. The presence of the secondary seal 18 has been found to reduce emissions up to 90% over that of insulations using only the primary seal 30. Sealing arrangements in accordance with the invention have been found capable of meeting a standard of no gap ($\frac{1}{8}$" or less) for 95% of the tank circumference and less than $\frac{1}{2}$" gap over the remaining 5% of the tank circumference.

While the invention has been particularly shown and described with reference to preferred embodiments thereof, it will be understood by those skilled in the art that the foregoing and other changes in form and details may be made therein without departing from the spirit and scope of the invention.

What is claimed is:

1. For use with a primary seal between the inner wall of a tank and a floating roof for the tank, a secondary seal comprising the combination of:

a flexible support arrangement mounted on and fastened to the floating roof, the support arrangement extending toward the inner wall of the tank and terminating in an outer edge having a length which is variable in response to flexure of the support arrangement toward and away from the inner wall of the tank;

a vapor barrier sealingly coupled to and extending between the floating roof and the outer edge of the support arrangement beneath the support arrangement; and a plurality of flexible wipers mounted on the outer edge of the support arrangement along the length thereof and extending in the direction of the inner wall of the tank.

2. The invention set forth in claim 1, wherein the plurality of wipers comprises two wipers, each of which has a plurality of breaks therein arranged in spaced-apart relation along the length thereof, the breaks in one of the wipers being staggered relative to the breaks in the other one of the wipers.

3. The invention set forth in claim 1, wherein the vapor barrier extends between the outer edge of the support arrangement and the plurality of wipers, around the edges of the plurality of wipers and over at least a part of the top one of the plurality of wipers so as to terminate at a location spaced-apart from the inner wall of the tank.

4. The invention set forth in claim 1, wherein the support arrangement comprises a plurality of support plates mounted in side-by-side relation along the floating roof, at least some of the support plates being slidably disposed relative to adjacent support plates to allow the length of the outer edge of the flexible support arrangement to vary in response to flexure of the support arrangement toward and away from the inner wall of the tank.

5. The invention set forth in claim 4, wherein each of the support plates is curved to form a generally flat upper lip at the outer edge of the support arrangement and the plurality of wipers extend along the top of and are fastened to the upper lips of the support plates.

6. The invention set forth in claim 5, further including a plurality of hold down bars mounted on top of the wipers in spaced-apart relation with each being disposed above the upper lip of a different one of the support plates, and wherein the plurality of wipers are fastened to the upper lips of the support plates by bolts which extend through the hold down bars, the plurality of wipers and the upper lips of the support plate.

7. The invention set forth in claim 6, further including a plurality of skid plates, each being mounted on the top of a different one of the hold down bars.

8. A secondary seal for use with a tank having a floating roof and a primary seal between the walls of the tank and the floating roof, the secondary seal comprising the combination of:

a plurality of support plates adapted to be mounted at the bottom edges thereof in side-by-side relation along and fastened to the floating roof, each of the support plates having a side edge overlapping and unfastened relative to a side edge of an adjacent support plate and a top edge opposite the bottom edge;

a pair of flexible wipers extending along and fastened to the top edges of the support plates, the pair of wipers extending outwardly from the top edges of the support plates along the lengths of the top edges and being adapted to engage the inside wall of the tank; and a vapor barrier element of flexible material sealingly coupled to and extending between the top and bottom edges of the support plates beneath the support plates.

9. The invention set forth in claim 8, wherein the vapor barrier element is configured to wrap around at least part of the pair of wipers.

10. The invention set forth in claim 8, wherein each of the pair of wipers has a plurality of separations therein spaced-apart along the length thereof and extending across at least a substantial portion of the width thereof, the separations of each of the wipers being staggered relative to the separations of the other one of the wipers.

11. An arrangement for sealing the space between the inner wall of a generally cylindrical tank and a generally circular floating roof on top of a liquid stored within the tank, the roof having a rim extending around the outer periphery thereof, comprising the combination of:

a primary seal comprising a flexible sealing element extending between and fastened to the inner wall of the tank and the rim of the roof; and a secondary seal extending between the inner wall of the tank and the rim of the roof above the primary seal and comprising a flexible support structure mounted on and fastened to the rim of the roof adjacent the primary seal, the support structure extending upwardly from the rim of the roof and toward the inner wall of the tank and terminating in an upper lip of generally circular configuration, the upper lip of the support structure being spaced-apart from and generally concentrically disposed relative to the inner wall of the tank and having a circumference which is variable in response to flexure of the support structure, the support structure being vapor-permeable, means for making the support structure generally vapor-impermeable, and at least one flexible wiper element mounted on the upper lip of the support structure and extending into contact with at least a substantial portion of the circumference of the inner wall of the tank.

12. The invention set forth in claim 11, wherein the means for making the support structure generally vapor-impermeable comprises a flexible vapor barrier element mounted beneath and generally coextensive with the support structure, the vapor barrier element extending between the support structure and the rim of the roof and between the support structure and the at least one flexible wiper element.

13. The invention set forth in claim 12, wherein the flexible sealing element of the primary seal extends between the rim of the roof and the vapor barrier element and support structure, and wherein the support structure, the vapor barrier element and the sealing element are joined to the rim of the roof by common fasteners.

14. The invention set forth in claim 12, wherein the vapor barrier element is wrapped around a substantial portion of the at least one flexible wiper element.

15. The invention set forth in claim 12, wherein the flexible vapor barrier element comprises reinforced polyurethane fabric.

16. The invention set forth in claim 11, wherein the support structure comprises a plurality of generally rectangular metal support plates mounted in side-by-side relation along the rim of the roof, each support plate overlapping and being free to move relative to the support plates on opposite sides thereof.

17. The invention set forth in claim 11, wherein the at least one flexible wiper element comprises a pair of flexible, generally planar wipers mounted in overlying relation on the upper lip of the support structure.

18. The invention set forth in claim 17, wherein the support structure comprises a plurality of support plates mounted in side-by-side relation along the rim of the roof, each support plate overlapping and being free to move relative to the support plates on opposite sides thereof and having a top lip forming a part of the upper lip of the support structure and having a plurality of apertures therein, the pair of wipers have a plurality of apertures therein spaced-apart along an edge thereof, and further including a plurality of bolts extending through the apertures in the pair of wipers and through the apertures in the top lips of the support plates to mount the pair of wipers on the top lips of the support plates.

* * * * *